United States Patent [19]

Essary et al.

[11] Patent Number: 4,541,579

[45] Date of Patent: Sep. 17, 1985

[54] SLITTER, WIND-UP CLUTCH ASSEMBLIES

[75] Inventors: James W. Essary; Robert A. Sanderson, both of Graham, Tex.

[73] Assignee: Graham Magnetics Incorporated, North Richland Hills, Tex.

[21] Appl. No.: 427,564

[22] Filed: Sep. 29, 1982

[51] Int. Cl.[4] ..... B65H 19/04

[52] U.S. Cl. ..... 242/56.2; 242/68.3

[58] Field of Search ..... 242/56.1, 56.2, 56.9, 242/68, 68.1, 68.3, 68.4; 267/50, 148, 149

[56] References Cited

U.S. PATENT DOCUMENTS

| | | | |
|---|---|---|---|
| 2,372,424 | 3/1945 | Ironside | 242/68.3 |
| 2,436,326 | 2/1948 | Pierce | 242/68 X |
| 3,159,389 | 12/1964 | Clary | 267/50 |
| 3,207,454 | 9/1965 | Bendar | 242/68.3 X |
| 3,347,485 | 10/1967 | Bundschuh | 242/68.3 |
| 3,357,652 | 12/1967 | Greifenhagen | 242/68.3 |
| 3,359,020 | 12/1967 | O'Donnell | 242/68.3 |
| 3,417,939 | 12/1968 | Bunting | 242/68.3 |
| 4,063,692 | 12/1977 | Buggy | 242/56.9 O |
| 4,327,301 | 4/1982 | Janson | 242/68.3 X |

*Primary Examiner*—Stephen Marcus
*Assistant Examiner*—Leo J. Peters
*Attorney, Agent, or Firm*—Andrew F. Kehoe

[57] ABSTRACT

A clutch means particularly useful in the rapid and precise alignment of a large number of rotating members such as take-up reels on a single shaft. Each rotating member, e.g., each reel-hub member, is positively engaged by a resilient and non-fouling spring member which is readily inserted into conventional clutch means and which comprises a cam means to facilitate the sliding passage of a number of reels onto a shaft as well as locking means to couple the clutch means and the reels to be rotated thereon.

14 Claims, 9 Drawing Figures

SLITTER, WIND-UP CLUTCH ASSEMBLIES

BACKGROUND OF THE INVENTION

This invention relates to improved clutch means and particularly to improved clutch means which allow a series of reels to be accurately and securely mounted for rotation on a single drive shaft with excellent predetermined alignment in the plane of rotation.

In some industrial processes, it is important to align a number of rotating members on a single shaft. In the more critical of such processes, it is necessary to assure the smooth driving action of each independent clutch mechanism and the avoidance of any wobble or speed difference between the rotating members within each mechanism. One such critical application is precision slitting of magnetic tape, e.g., computer tape, wherein it is absolutely necessary that reels, on which the tape is received from the slitter, are free from slip and wobble. Moreover, since a great many reels will normally be mounted on a single shaft, it is desirable to be able to put them on over the shaft for a considerable distance with no damage to the reels which result in eccentric motion of the reel during use.

Although no prior art has been found which relates to the above-described problem, certain clutch mechanisms are described in U.S. Pat. Nos. 2,713,405 and 2,907,432 which move outwardly to engage, and cause rotation of, various members. It is to be noted that this comment on earlier work is necessarily made in hindsight and is not intended to imply that it was related to the present invention, at the time the invention was made, in the eyes of those skilled in the art and who had no knowledge of the invention disclosed below.

SUMMARY OF THE INVENTION

It is a principal object of the invention to provide improved clutch means for securely fastening a large number of reels or other such rotating members on a common shaft.

Another object of the invention is the provision of a novel spring-type clutch member which aids obtaining the desired locking of reels on the shaft.

Another object of the invention is to provide an improved apparatus for winding a plurality of rolls of magnetic tape on a single shaft.

Another object of the invention is to provide an improved web packaging means for use with slitting equipment.

Other objects of the invention will be obvious to those skilled in the art on their reading of the present description.

The above objects have been substantially achieved by utilization of a combination spring and drive pawl, which provides an excellent positive drive connection between wind-up reels and clutch means. They may be loaded onto a shaft, within clutch members, without substantial risk of damage to either the clutches or reel members mounted thereon. Although other leafspring type constructions can be used, the spring-pawl member is a single piece pawl member which may be fitted into existing clutch mechanisms and which carry a cam operable at right angles to the rotation of the pawl. Usually only a portion of a conventional clutch housing may be cut away to facilitate assembly of the clutch. However, as will be seen in the preferred embodiment, the clutch may also be modified to comprise mounting members for the spring.

The most advantageous drive pawls of the invention are one-piece springs formed of engineering plastics such as nylon, polycarbonates or polysulfones. Particularly good materials are molded of polycarbonate or nylon blended with a small amount of a lubricant like molybdenum disulphide or fluoroethylene polymer to decrease the friction characteristics of the pawls.

An important aspect of the invention is the fact that machine productivity can be improved markedly by the rapid transfer of reels from and to the slitter operating shafts under conditions that assure proper seating of the reels on shaft-borne clutches.

ILLUSTRATIVE EXAMPLE OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for the purposes of illustration in order that others skilled in the art will more fully understand the invention and the principles thereof and will be able to modify it and embody it in a variety of forms, each as may be best suited to the condition of a particular case.

IN THE DRAWINGS

Figure 1:
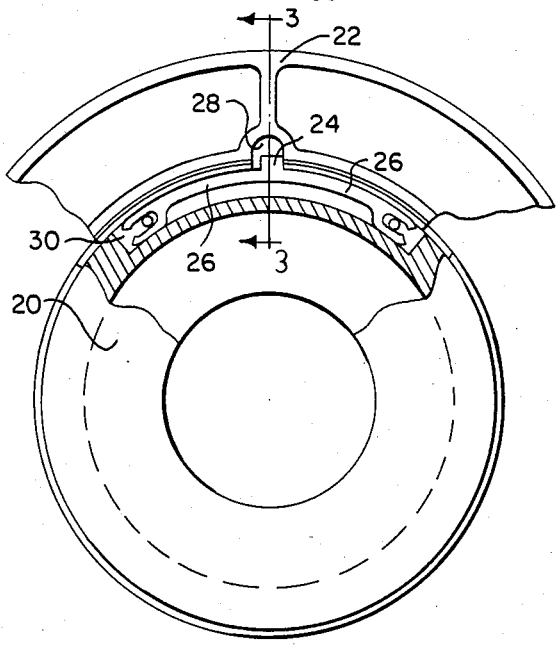
FIG. 1 is a side view, partly schematic, of a clutch and reel assembly used in the present invention.

Referring to FIG. 1, it is seen that a clutch member 20 serves as a hub means for a reel 22. The connection of clutch 20 and reel 22 is made by a drive pawl 24 molded into a spring member 26 and adapted to engage any of slots 28 within the reel structure 22.

In general, the clutch can be selected from many commerically-available clutch devices and readily modified by cutting the housing to provide a housing slot therein, as at 30, for receiving spring 26.

Figure 2:
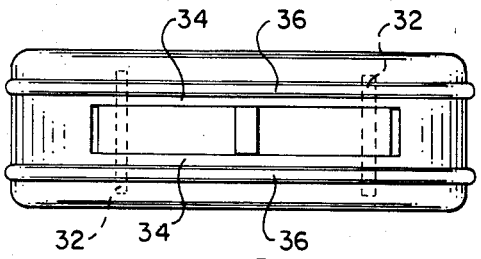
FIG. 2 is a fragmentary plan view of the assembly of FIG. 1.
Figure 3:
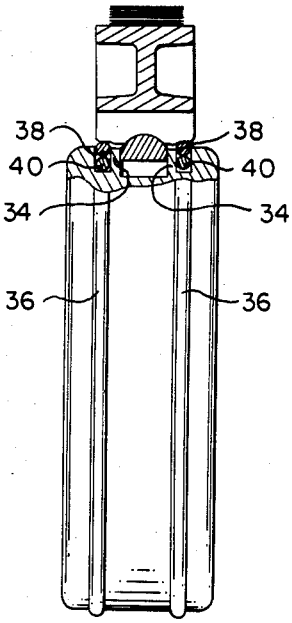
FIG. 3 is a side elevation, partly in section, of the clutch and reel assembly of FIG. 1.
Figure 6:
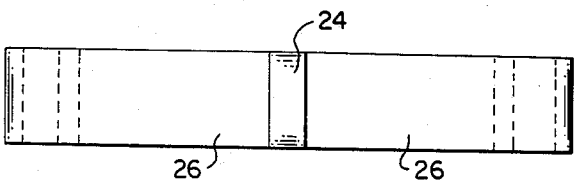
FIG. 6 is a plan view of a spring useful in the clutch and reel assembly of the invention.

As seen in FIGS. 2 and 3, the terminal of spring 26 are slidably positioned on pins 32 which themselves are held within wall sections 34 formed by slot 30 and exterior slots 36 which form positioning means for a garter spring 38 and an O-ring 40. Spring 38 and O-ring 40 bear against, and help position, reel 22 on clutch 20.

Reel 22 is suitably formed of aluminum and can be the general type that meets the National Association of Broadcasters specification commonly used in reeling film and tape. Presently used hubs have been modified to include a knurled interior circumferential wall which, with the aforesaid garter spring, forms a mechanical coupling between the reel and the clutch. However, in the practice of the present invention, the knurled surface has proved to be an undesired abrasive feature and it has been replaced with a relatively smooth interior circumferential wall 50 as seen in FIG. 4.

Figure 4:
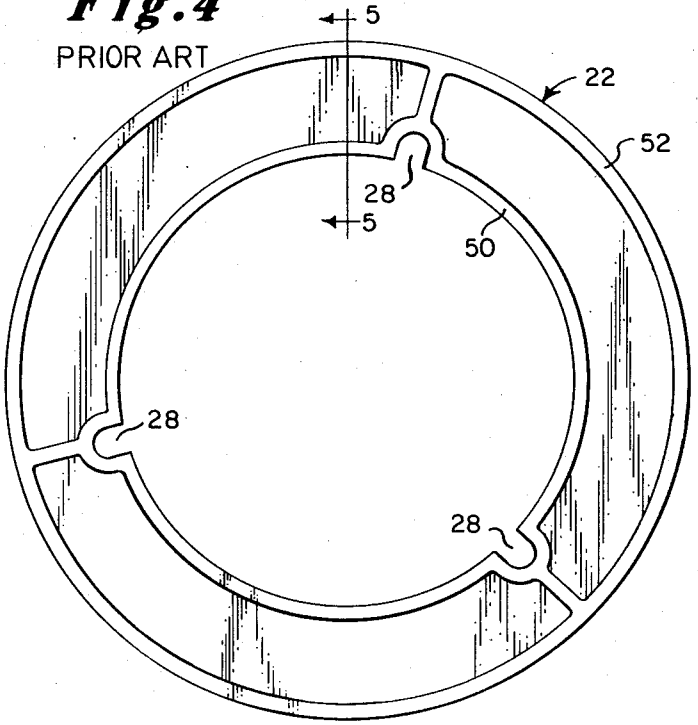
Fig. 4 PRIOR ART
FIG. 4 is an elevation of a prior art reel useful with the assembly of FIGS. 1 through 3.

FIG. 4 is an elevation of a reel or hub 22 which is of the type generally referred to as a NAB hub, i.e., a hub or reel that meets the aforesaid Standard of the National Association of Broadcasters. As is not uncommon in such hubs, it is designed for use with a variety of equipment. However, of particular interest in the application described herein are outer circumferential wall 52 on which magnetic tape or a like tape product is to be wound the inner circumferential wall 50 which is to slide over and co-operate with a clutch mechanism. Wall 50 comprises three lateral slots 28 spaced at 120 angular degrees from one another in which the drive panel may be received when it is allowed to move outwardly into it normally engaged drive position.

Figure 5:
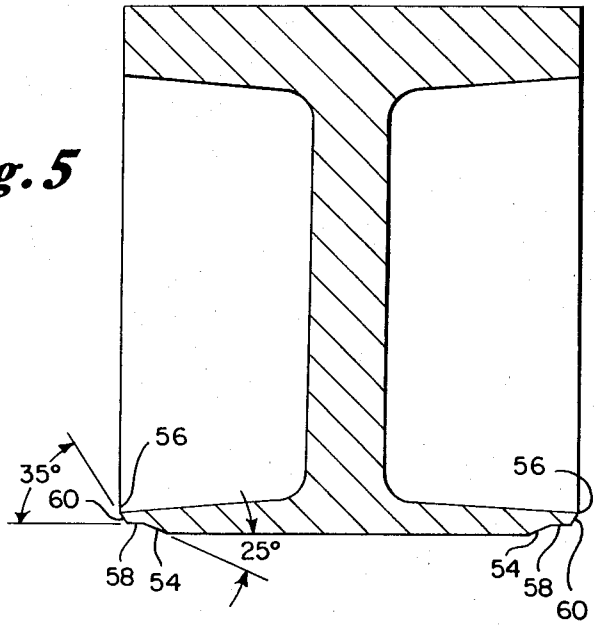
FIG. 5 is an enlarged cross-section of the reel along line 5:5 of FIG. 4 with further modifications

As seen in more detail in FIG. 5, the inner wall, indicated by reference numeral 50 in FIG. 4, 50 is not flat but comprises a 25-degree-angled wall section 54 near each edge 56. These sections 54 terminate even nearer the edge, flat retainer wall sections 58 and finally cam wall portions 70 angled at 35 degrees to the horizontal.

Figure 7:
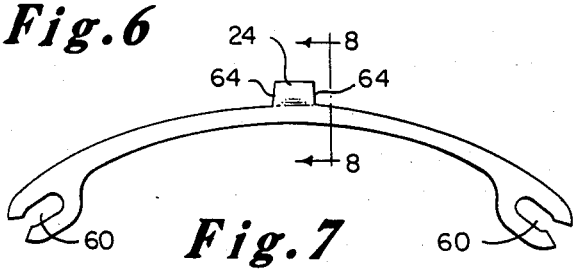
FIG. 7 is a plan elevation of the spring of FIG. 6.
Figure 8:
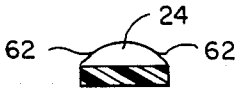
FIG. 8 is a side view of a cam member of the spring of FIGS. 6–7.

Spring member 26 is a resilient elongate spring which engages pins 32. Pins 32 are slidable within pin support means, i.e., pin slots 60 so that when the force is exerted downwardly on pawl 24, spring 26 can readily be depressed so that it will slide smoothly beneath the surface 50 of hub 22. As seen in FIGS. 7 and 8, pawl 24 comprises cam, or wedge-type faces 62 which form cam means to aid in depressing the spring with a minimum of applied force as it is moved over the cam-bearing clutches, i.e., over a series of hubs 22. The leading edge of the pawl 64, however, are not cams but are formed to provide bearing surfaces for driving the hub by engaging slots 28.

The illustrated spring 26 is formed of a polycarbonate material or other such abrasion-resistant organic resin. Blending a small amount of a fluorinated hydrocarbon with the polycarbonate to reduce the coefficient of friction has been found to be desirable.

The drive described herein is an excellent positive drive mechanism. It is less susceptible to losing its snug, positive drive characteristics because it is relatively insensitive to tolerance deviations in manufacture of the hub and to dimensioned change caused by wear on the hub.

The molded one-piece spring coupling means is easy and inexpensive to manufacture and resists wear during the repeated sliding of the hubs over the clutch assembly. This is true even when the forces exerted on the hubs are not precisely parallel to the shaft. Moreover, the spring is highly resistant to fouling by metal chips or other debris and resists damage. However, if it is damaged, it is readily replaced without taking apart the clutch and indeed, even without the required use of tools.

Figure 9:
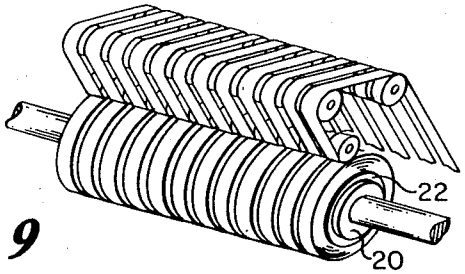
FIG. 9 is a schematic representation of the way the apparatus of the invention is utilized on a slitting line.

FIG. 9 is a perspective view of the take-off, or wind-up, end of a slitting machine. Strips of slit magnetic tape are wound on reels 22 which are mounted, in turn on magnetic clutches 20. It is to be noted that the body of spring 26 forms a cover which is a convenient lowfriction replacement for clutch housing segment which has been removed to facilitate manufacture of the apparatus from a commercially available clutch mechanism.

The reels 22 are mounted on a removable arbor and may be readily lifted from the apparatus and quickly and easily removed from the shaft on which they are mounted, leaving the clutch-and-spring mechanism on the shaft. Conversely, when it is time to place empty reels on the shaft, they are readily pushed on, even as a group.

As shown in FIG. 9, the particular advantage of the invention is realized in a precision slitting process wherein a web of magnetic tape is fed into a slitting apparatus where the web is converted into a large number of tapes of, e.g., about 0.5 -inch width. These tapes are then wound up on about NAB hubs of the type described herein.

The spring and pawl apparatus described herein makes it easy to slide the hub over the clutch without paying any attention to the registration of the spring and the hub. When the clutch is rotated, however, the springs are quickly, i.e., within a 120° arc, brought into engagement with a drive slot 28.

The clutch is preferably a magnetic clutch and forms a torque limiting means for the winding operation.

It is also to be understood that the following claims are intended to cover all of the generic and specific features of the invention herein described and all statements of the scope of the invention which might be said to fall therebetween.

What is claimed is:

1. In precision slitting apparatus of the type comprising means to feed a relatively wide web into a plurality of slitting means for converting said web into a plurality of relatively narrow webs, and means to wind up said narrow webs on a large number of hubs, each hub being mounted on a common rotatable shaft by means of an individual torquelimiting clutch means each dedicated to a reel, the improvement;

wherein said clutch means comprises an elongate and resilient spring means mounted within, and proximate to a segment of, the outer periphery of said clutch means said spring means bearing a pawl member which, in normal position, extends outwardly beyond said periphery;

wherein said pawl member comprises cam-shaped shoulders on two opposite sides thereof that are substantially parallel to the direction of rotation of said shaft, said shoulders forming wedges to aid depressing of said pawl from its normal position into a position retracted with respect to an inner circumferential wall of a reel in response to forces exerted on said pawl by hubs being pushed onto or over said clutch means in a direction parallel to the axis of rotation of;

wherein said pawl member comprises a bearing surface on at least one side of said pawl which is normal to the direction of rotation; said bearing surface forming means to engage a slot in said hub when said pawl is in said normal position;

and wherein said apparatus also comprises, mounted circumferentially around the housing of said clutch means and extending therefrom on each side of said pawl, resilient support rings which forms both (a) means to stabilize the position of said reel on said clutch and (b) means to allow release of said reel from said common shaft in response to the pulling action on said common shaft.

2. Apparatus as defined in claim 1 wherein said torque-limiting clutch is a magnetic clutch.

3. Apparatus as defined in claim 1 wherein said spring and said pawl means are unitary and formed of a blend of a thermoplastic polymer comprising, admixed therein, a lubricant-enhancing additive.

4. Apparatus as defined in claim 1 wherein said reel comprises a plurality of circumferentially spaced slots to accept said pawl member when said pawl is rotated into registration with one said slot.

5. Apparatus as defined in claim 1 wherein said spring support means is mounted in said clutch means by pin support means on said clutch which form means to engage pin support slots on the extremities of said pawl means.

6. Apparatus as defined in claim 4 wherein said reel has a smooth non-abrasive inner circumferential face in which said slots are formed and in which the outer wall positions are angled to facilitate sliding engagement with said bearing surfaces on said pawl.

7. Apparatus as defined in claim 3 wherein a reel comprises a plurality of circumferentially spaced slots to accept said pawl means when it is rotated into registration therewith.

8. Apparatus as defined in claim 7 wherein said reel is generally "I-shaped" in crossection and has a smooth-non-abrasive inner circumferential wall having a face in which said slots are formed and in which said outer edges of such inner wall are angled to form cam means which facilitate sliding engagement with said bearing surfaces on said pawl.

9. In precision slitting apparatus of the type comprising means to feed a relatively wide web into a plurality of slitting means for converting said web into a plurality of relatively narrow webs, and means to wind up said narrow webs on a large number of hubs, each hub being mounted on a common rotatable shaft by means of an individual torquelimiting clutch means each dedicated to a reel, the improvement;

wherein said clutch means comprises an elongate and resilient spring means mounted within, and proximate to a segment of, the outer periphery of said cluch means said spring means bearing a pawl member which, in normal position, extends outwardly beyond said periphery;

wherein said pawl member comprises cam-shaped shoulders on two opposite sides thereof that are substantially parallel to the direction of rotation of said shaft, said shoulders forming wedges to aid depressing of said pawl from its normal position into a position retracted with respect to an inner circumferential wall of a reel in response to forces exerted on said pawl by hubs being pushed onto or over said clutch means in a direction parallel to the axis of rotation of;

wherein said pawl member comprises a bearing surface on at least one side of said pawl which is normal to the direction of rotation; said bearing surface forming means to engage a slot in said hub when said pawl is in said normal position;

and wherein said spring support means is mounted in said clutch means by pin support means on said clutch which form means to engage pin support slots on the extremities of said pawl means.

10. Apparatus as defined in claim 9 wherein said clutch means is a magnetic clutch means.

11. Apparatus as defined in claim 9 wherein said spring and said pawl means are unitary and formed of a blend of thermoplastic polymer comprising, admixed therein, a lubricantenhancing additive.

12. Apparatus as defined in claim 11 wherein a reel comprises a plurality of circumferentially spaced slots to accept said pawl means when it is rotated into registration therewith.

13. Apparatus as defined in claim 12 wherein said reel has a smooth non-abrasive inner circumferential face in which said slots are formed and in which the outer wall positions are angled to facilitate sliding engagement with at least one bearing surface on said pawl.

14. A clutch assembly adapted for rotation on a shaft formed of a torquelimiting clutch and a hub means wherein said clutch means comprises an elongated and resilient spring means the ends of which are mounted for slidable movement within said clutch means, said spring means bearing a pawl member which, in normal position, extends outwardly from the outer periphery of said clutch means, wherein said pawl member comprises cam-shaped shoulders on two opposite sides thereof that are generally parallel to the direction of rotation of said clutch means on said shaft, said shoulders forming wedges to aid depressing of said pawl from its said normal position into a retracted position in response to forces exerted on said pawl by hubs being pushed onto or over said clutch means in a direction generally perpendicular to rotation of said clutch means on said shaft and, wherein said pawl member comprises a bearing surface on at least one side of said pawl which is normal to said cam-shaped shoulders, said bearing surface forming means to engage a slot in said hub when said pawl is in said normal position.

* * * * *